US006902444B1

(12) United States Patent
Shannon, Jr.

(10) Patent No.: US 6,902,444 B1
(45) Date of Patent: Jun. 7, 2005

(54) BATTERY TERMINAL CONNECTION ASSEMBLY

(75) Inventor: John K. Shannon, Jr., Franksville, WI (US)

(73) Assignee: Quick Cable Corporation, Franksville, WI (US)

( * ) Notice: Subject to any disclaimer, the term of this patent is extended or adjusted under 35 U.S.C. 154(b) by 0 days.

(21) Appl. No.: 10/765,339

(22) Filed: Jan. 27, 2004

(51) Int. Cl.[7] ..... H01R 11/01
(52) U.S. Cl. ..... 439/756; 439/762; 439/805
(58) Field of Search ..... 439/756, 762, 439/754, 805, 784

(56) References Cited

U.S. PATENT DOCUMENTS 1,300,431 A * 4/1919 Luthy ..... 439/805
1,653,833 A * 12/1927 Atkinson ..... 439/762
1,714,762 A * 5/1929 Bone ..... 439/762
1,802,381 A * 4/1931 Hofbauer ..... 439/756
3,673,550 A 6/1972 Sherman
3,955,044 A 5/1976 Hoffman et al.
4,118,097 A 10/1978 Budnick
4,934,958 A 6/1990 Julian
6,053,779 A 4/2000 Liang
D470,461 S 2/2003 Liang

* cited by examiner

*Primary Examiner*—Tho D. Ta
(74) *Attorney, Agent, or Firm*—Jansson, Shupe & Munger, Ltd.

(57) ABSTRACT

A battery terminal connection assembly for connecting a terminal to a cable is disclosed. The assembly preferably includes a conductive cable fitting for connection to a cable, a conductive terminal connector having an arm adapted to engage the terminal, a cold-flow-resistant sleeve positioned in and bonded to the connector, the sleeve defining a bore for receiving the cable fitting, and a tensioning member adapted to connect to and urge the cable fitting into contact with the bore. When assembled, the tensioning member ensures electrical contact between the cable and the terminal. The invention also includes a battery terminal and cable connection arrangement utilizing such a connection assembly.

20 Claims, 3 Drawing Sheets

20
21
22
23
24
25
26
27
28
30
31
32
40
41
42
43
44
45
46
4
6

BATTERY TERMINAL CONNECTION ASSEMBLY

FIELD OF THE INVENTION

The invention relates to the field of electrical connections, and, more particularly, to connections between battery terminals ans cables.

BACKGROUND OF THE INVENTION

Powerful batteries are necessary for many devices utilized today. For instance, material handling equipment, lift trucks and other similar vehicles require batteries for use. Such equipment typically experiences rough treatment and must have durable electrical connections.

In the past, two methods have been used to provide such connection between the power source and the equipment. The first method required that the end of a cable be stripped of its protective insulation and welded directly to the battery terminal. Such a connection provided extremely durable electrical connection. However, the welding resulted in a near-permanent connection. Such a connection was a hindrance after the battery's power was depleted. Typically, disconnection could only be performed by additional welding. Because welding flames are not permitted in many warehouse or other industrial settings, removal had to be performed offsite which is timely and costly. In addition, such welding often ruined the battery for future use, i.e., recharging and reuse.

The second method utilized a terminal connector which provided acceptable connection to the battery terminal. The terminal connector was connected to the cable through a friction fit. However, because the terminal connector was a "soft" metal which experienced "cold flow," the connection between the terminal connector and the cable frequently became loose. Cold flow occurs when pressure is applied to a material and it flows away from the pressure. For instance, a threaded cavity in a lead material will experience cold flow when a screw is threaded into the cavity and stress is applied, i.e., the lead threads will move with respect to the cavity and loosen the connection between the screw and the lead material. Loosened connections result in electrical loss, potentially dangerous heat, and increased potential for corrosion. Therefore, this method of battery connection has required frequent tightening between the terminal connector and the cable. However, in practice such maintenance is not routinely performed and the battery connection suffers the above-noted problems.

Therefore, there is a need in the prior art for a method of connecting a battery to a cable which provides for durable electrical connection and removability.

A battery terminal connection assembly which addresses the problems of known devices would be an important advance in the art.

OBJECTS OF THE INVENTION

It is an object of the invention to provide a battery terminal connection assembly which overcomes the problems in the prior art.

Another object of the invention is to provide a battery terminal connection assembly which avoids cold flow by utilizing a cold-flow resistant sleeve to provide connection between the terminal and cable.

Another object of the invention is to provide a removable battery terminal connection assembly which provides a connection which is not affected by cold flow.

Another object of the invention is to provide a battery terminal and cable connection arrangement which provides for durable electrical connection.

Another object of the invention is to provide a battery terminal and cable connection arrangement which allows for quick and easy connection and disconnection.

Another object of the invention is to provide a battery terminal connection assembly which provides for connection and disconnection between a cable and battery terminals of various sizes.

Yet another object of the invention is to provide a battery terminal connection assembly which utilizes enduring friction contact between a cable fitting and a terminal connector to ensure electrical contact between a cable and a battery.

Still another object of the invention is to provide an efficient and economical way provide durable electrical connection between a battery terminal and a cable.

How these and other objects are accomplished will become apparent from the following descriptions and drawings herein.

SUMMARY OF THE INVENTION

This invention is a battery terminal connection assembly for connecting a battery terminal to a cable. The invention represents a significant advance over the state of the art by providing novel elements to provide improved and longer connection between terminals and cables.

The battery terminal connection assembly comprises a conductive cable fitting having a first and second end, a conductive terminal connector having an arm adapted to engage the terminal and including a hole, a cold-flow-resistant sleeve defining a bore for receiving the second end of the cable fitting positioned in the hole and bonded to the connector, and a tensioning member adapted to connect to the second end to urge the cable fitting into contact with the bore. The arm preferably forms an opening which is adapted to receive the terminal. The bore preferably defines a bore axis along which the tensioning member is adapted to urge the cable fitting. When assembled, the assembly allows the tensioning member to ensure electrical contact between the cable and the terminal.

The second end of the cable fitting preferably includes a cavity to receive the tensioning member. In certain preferred embodiments, the cavity is threaded and the tensioning member is a threaded bolt such that the bolt and cable fitting can be screwed together to urge the fitting into the bore along the bore axis. In such embodiments the cable fitting preferably includes an external portion adapted to be gripped when the bolt and cable fitting are screwed together. For instance, the external portion may be raised such that it can be engaged by a wrench. The tensioning member preferably includes a head and a lock washer which is adapted to abut the head and the connector when the bolt and cable fitting are screwed together. In certain embodiments, a washer is positioned between the lock washer and the connector.

The first end of the cable fitting preferably includes a recess adapted to receive the cable. The recess is preferably dimensioned to snugly receive the cable. The connection between the cable fitting and cable may be further strengthened by welding, soldering or other through other means.

The sleeve preferably extends from a proximal end to a distal end with at least one of the ends being non-circular such that rotation of the sleeve relative to the connector is prevented. For instance, the outer shape of the sleeve and the inner shape of the hole in the connector can be square-like, thus preventing rotation of the sleeve relative to the connector. As is understood, a sleeve and hole having any non-circular shape would prevent such rotation.

In certain embodiments, the cable fitting has a conical portion terminating at the second end and the bore has a conical portion terminating at the proximal end such that the cable fitting mates with the bore. In such embodiments, the conical portion of the cable fitting can be considered a shoulder which is urged into contact with the bore by the tensioning member. In other embodiments, a shoulder with a surface substantially perpendicular to the bore axis is urged into contact with the bore by the tensioning member.

The invention is also a battery terminal and cable connection arrangement which comprises a battery having a terminal; a conductive terminal connector having a hole and an arm adapted to engage the terminal; a cold-flow-resistant sleeve positioned in the hole, bonded to the connector, and defining a bore extending from a proximal end to a distal end; a conductive cable fitting having first and second ends and entering the proximal end such that the second end is received within the bore; a tensioning member entering the distal end of the bore, fixed to the second end of the fitting, and urging the cable fitting into contact with the bore; and a conductive cable fixed to the first end of the cable fitting. The terminal is preferably a terminal post which is received in and secured to an opening formed by the arm.

The invention can also be described as a battery terminal and cable connection arrangement comprising a battery having a terminal; a conductive terminal connector having a hole and a first connecting means for connecting to the terminal; a cold-flow-resistant sleeve positioned in the hole and bonded to the connector, the sleeve defining a bore extending from a proximal end to a distal end; a conductive cable fitting having first and second ends, a second connecting means at the second end for urging the fitting into connection with the terminal connector, the second end received within the bore; and a conductive cable fixed to the first end of the cable fitting.

BRIEF DESCRIPTION OF THE DRAWINGS

The drawings illustrate preferred embodiments which include the above-noted characteristics and features of the invention. The invention will be readily understood from the descriptions and from the drawings, in which.

DETAILED DESCRIPTION OF PREFERRED EMBODIMENTS

Figure 1:
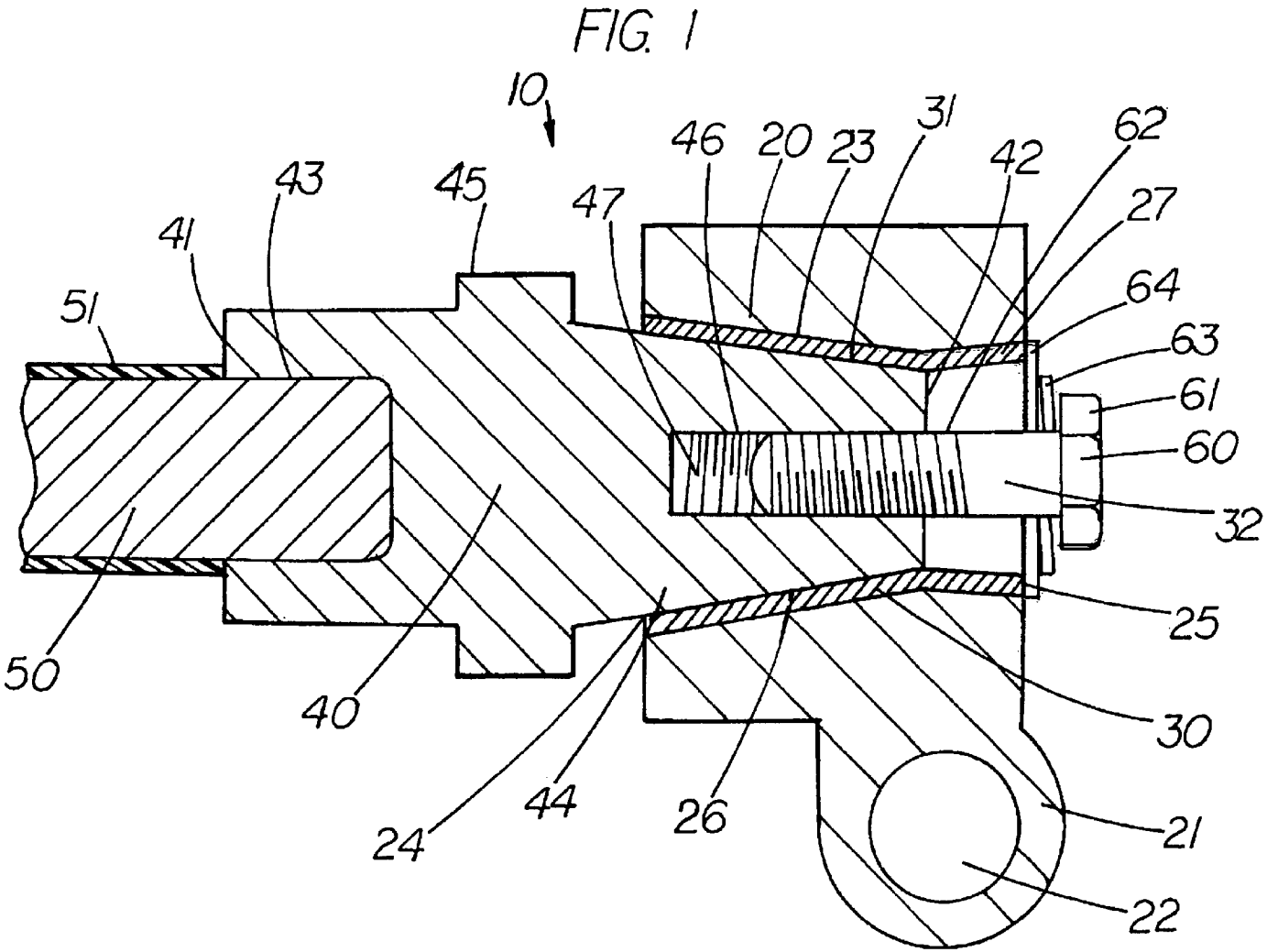
FIG. 1 is a cross sectional view of a preferred battery terminal connection assembly shown in connection with a cable in accordance with the invention.
Figures 2, 3, 4, 5, 6:
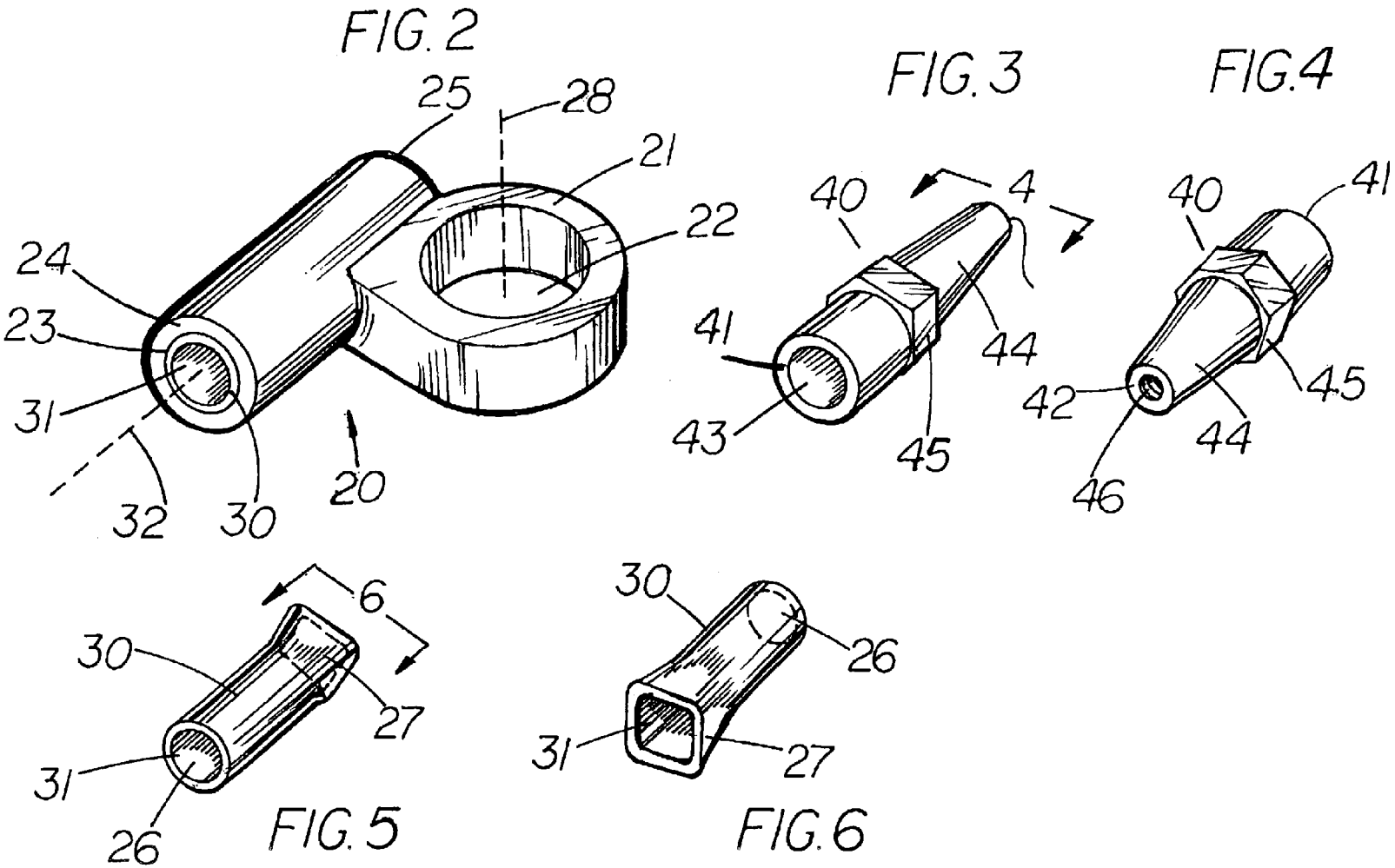
FIG. 2 is a perspective view of a preferred terminal connector in accordance with the invention.
FIG. 3 is a perspective view of a preferred cable fitting in accordance with the invention.
FIG. 4 is a perspective view of the preferred cable fitting of FIG. 3 taken from line 4 in FIG. 3 in accordance with the invention.
FIG. 5 is a perspective view of a preferred sleeve in accordance with the invention.
FIG. 6 is a perspective view of the preferred sleeve of FIG. 5 taken from line 6 in FIG. 5 in accordance with the invention.

Referring to FIG. 1, details of the battery terminal connection assembly 10 for connecting a battery terminal to a cable 50 will be set forth. The battery terminal connection assembly 10 includes a terminal connector 20 which has an arm 21 that is adapted to engage a battery terminal. Terminal connector 20 is preferably lead or another conductive material which is easily cast or otherwise formed. In preferred embodiments, the arm 21 forms an circular opening 22 which receives a battery terminal post. Terminal connector 20 also includes a hole 23 which extends from a proximal end 24 to a distal end 25.

Received within and bonded to hole 23 is sleeve 30 which is formed from a cold-flow-resistant material such as copper, brass, bronze, or other alloys or materials which are conductive and which do not exhibit cold flow characteristics. Sleeve 30 is preferably tin-plated on its external side which contacts hole 23 to provide for maximum bonding between sleeve 30 and hole 23. Sleeve 30 defines a bore 31 which further defines a bore axis 32. Sleeve 30 also extends from proximal end 24 to distal end 25 and preferably includes a conical portion 26 in which the outer and inner diameters of sleeve 30 decrease from proximal end 24 to a position between proximal and distal ends 24,25. Sleeve 30 further includes a non-circular portion 27 which prevents rotation between sleeve 30 and terminal connector 20 even under extreme stress. As is apparent from the FIGURES, the outer shape of sleeve 30 matches the shape of hole 23 such that sleeve 30 is completed bounded by and bonded to hole 23. For instance, as shown, hole 23 includes a conical portion which matches conical portion 26 and a non-circular portion which matches non-circular portion 27.

The battery terminal connection assembly 10 also includes a cable fitting 40 which extends from a first end 41 to a second end 42. First end 41 is adapted to connect to cable 50 and second end 42 is adapted to be received within and connected to terminal connector 20. As shown, first end 41 includes a recess 43 which receives cable 50. Cable 50 can be welded, soldered or otherwise fixed to first end 41. As shown, insulation 51 around cable 50 stops at first end 41 so that the conducting component of cable 50 is snugly received within recess 43.

Cable fitting 40 preferably includes a conical portion 44 which corresponds to conical portion 26 of sleeve 30. In other words, conical portion 44 mates with conical portion 26 such that connection between cable fitting 40 and terminal connector 20 occurs substantially along the entire surface of conical portion 44 which enters bore 31. Cable fitting 40 also includes a engagement portion 45 which allows cable fitting 40 to be gripped, preferably by a wrench, while cable fitting 40 is fixed to terminal connector 20.

Cable fitting 40 further includes a cavity 46 at second end 42 which provides for connection with tensioning member 60. Cavity 46 is preferably threaded such that tensioning member 60 may be a threaded bolt which can be screwed into cavity 46 (while cable fitting 40 is gripped at engagement portion 45). Cavity 46 defines a cavity axis 47 which is aligned with bore axis 32.

Tensioning member 60 includes a head 61, a lock washer 63 and a washer 64 which cooperate to contact the distal end of terminal connector 20 adjacent bore 31. Tensioning member 60 is connected to cable fitting 40 and draws cable fitting 40 into bore 31 until head 61, lock washer 63 and/or washer 64 are in tight contact with terminal connector 20 such that tensioning member 60 can draw cable fitting 40 into bore no farther. Because sleeve 30 is cold-flow-resistant, the tight contact between cable fitting 40 and terminal connector 20 does not weaken and require further tensioning of the connection.

FIGS. 2–6 show perspective views of terminal connector 20, cable fitting 40, and sleeve 30. As can be seen bore 31 and opening 22 are relatively positioned such that bore axis 32 and opening axis 28 are skew (they do not intersect and lie in different planes). Preferably, when opening axis 28 is vertical the bore axis 32 is horizontal.

Sleeve 30 is shown more clearly shifting from a circular and conical portion 26 to a non-circular portion 27. Thickness of sleeve 30 is preferably substantially constant such that conical portion 26 and non-circular portion 27 are exhibited in both the outer surface and inner surface of sleeve 30.

Figure 7:
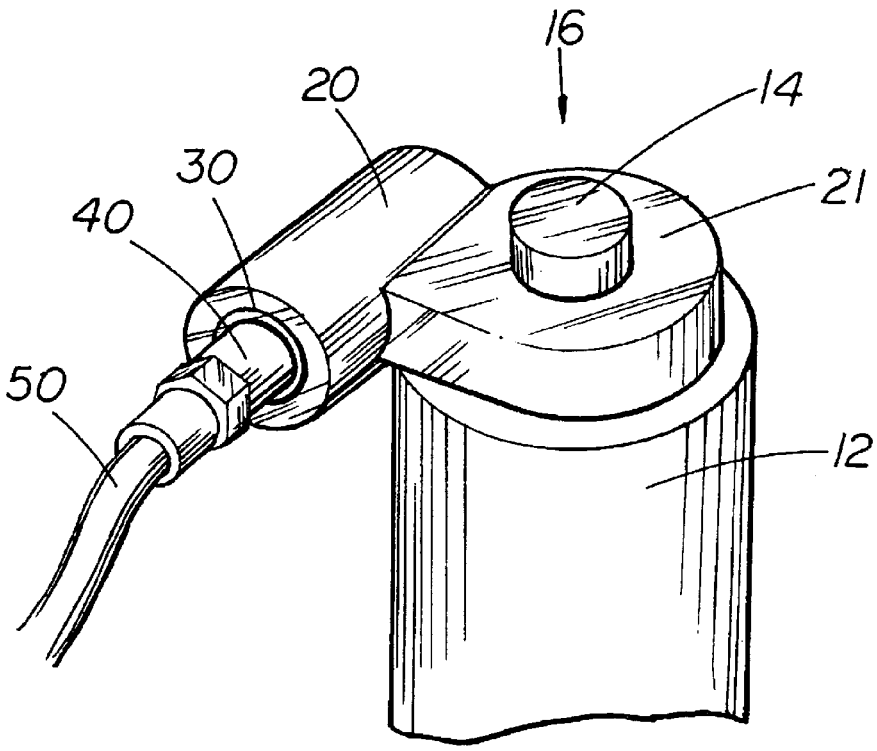
FIG. 7 is a perspective view of a preferred battery terminal and cable connection arrangement in accordance with the invention.

FIG. 7 depicts a preferred battery terminal and cable connection arrangement 16 in which battery 12 includes a terminal 14 in the form of a terminal post. Terminal 14 is received within the opening formed by arm 21. Arrangement 16 provides for durable connection between cable 50 and battery terminal 14.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A battery terminal connection assembly for connecting a terminal to a cable, the assembly comprising:

a conductive cable fitting having a first and second end, the first end for connection to a cable;

a conductive terminal connector having an arm adapted to engage the terminal, the connector including a hole;

a cold-flow-resistant sleeve positioned in the hole and bonded to the connector, the sleeve defining a bore for receiving the second end of the cable fitting; and a tensioning member adapted to connect to the second end to urge the cable fitting into contact with the bore;

whereby, when assembled, the tensioning member ensures electrical contact between the cable and the terminal.

2. The connection assembly of claim 1 wherein the first end of the cable fitting includes a recess adapted to receive the cable.

3. The connection assembly of claim 1 wherein the arm forms an opening which is adapted to receive the terminal.

4. The connection assembly of claim 1 wherein the bore defines a bore axis and the tensioning member is adapted to urge the cable fitting along the bore axis.

5. The connection assembly of claim 4 wherein the tensioning member is a threaded bolt and the second end includes a threaded cavity such that the bolt and cable fitting are screwed together to urge the fitting into the bore along the bore axis.

6. The connection assembly of claim 5 wherein the bolt includes a head and the tensioning member further comprises a lock washer which is adapted to abut the head and the connector when the bolt and cable fitting are screwed together.

7. The connection assembly of claim 5 wherein the cable fitting includes an external portion adapted to be gripped when the bolt and cable fitting are screwed together.

8. The connection assembly of claim 1 wherein the sleeve has proximal and distal ends, at least one of the ends being non-circular, such that rotation of the sleeve relative to the connector is prevented.

9. The connection assembly of claim 8 wherein the cable fitting has a conical portion terminating at the second end and the bore has a conical portion terminating at the proximal end such that the cable fitting mates with the bore.

10. A battery terminal and cable connection arrangement comprising:

a battery having a terminal;

a conductive terminal connector having an arm engaging the terminal, the connector including a hole;

a cold-flow-resistant sleeve positioned in the hole and bonded to the connector, the sleeve defining a bore extending from a proximal end to a distal end;

a conductive cable fitting having first and second ends, the fitting entering the proximal end such that the second end is received within the bore;

a tensioning member entering the distal end of the bore and fixed to the second end of the fitting, the tensioning member urging the cable fitting into contact with the bore; and a conductive cable fixed to the first end of the cable fitting.

11. The terminal and cable connection arrangement of claim 10 wherein the terminal is a terminal post and the arm forms an opening such that the terminal post is received in the opening and secured to the arm.

12. The terminal and cable connection arrangement of claim 10 wherein the bore defines a bore axis and the tensioning member is adapted to urge the cable fitting along the bore axis.

13. The terminal and cable connection arrangement of claim 10 wherein the tensioning member is a threaded bolt and the second end includes a threaded cavity such that the bolt and cable fitting are screwed together to urge the fitting into the bore along the bore axis.

14. The terminal and cable connection arrangement of claim 10 wherein the first end of the cable fitting includes a recess adapted to receive the cable.

15. The terminal and cable connection arrangement of claim 10 wherein at least one of the proximal and distal ends is non-circular such that rotation of the sleeve relative to the connector is prevented.

16. The terminal and cable connection arrangement of claim 10 wherein the cable fitting has a conical portion terminating at the second end and the bore has a conical portion terminating at the proximal end such that the cable fitting mates with the bore.

17. A battery terminal and cable connection arrangement comprising:

a battery having a terminal;

a conductive terminal connector having a hole and a first connecting means connected to the terminal;

a cold-flow-resistant sleeve positioned in the hole and bonded to the connector, the sleeve defining a bore extending from a proximal end to a distal end;

a conductive cable fitting having first and second ends and a second connecting means at the second end, the second connecting means urging the fitting into connection with the terminal connector such that the second end is received within the bore; and a conductive cable fixed to the first end of the cable fitting.

18. The terminal and cable connection arrangement of claim 17 wherein the terminal is a terminal post and the first connecting means is an arm, the arm forming an opening such that the terminal post is received in the opening and secured to the arm.

19. The terminal and cable connection arrangement of claim 17 wherein the bore defines a bore axis and the second connecting means urges the cable fitting along the bore axis.

20. The terminal and cable connection arrangement of claim 17 wherein at least one of the proximal and distal ends is non-circular such that rotation of the sleeve relative to the connector is prevented.

* * * * *